US010343865B2

(12) United States Patent
Wimmer et al.

(10) Patent No.: US 10,343,865 B2
(45) Date of Patent: Jul. 9, 2019

(54) METHOD AND DEVICE FOR HANDLING FLAT AND/OR FILM MATERIAL WOUND ONTO ROLLERS

(71) Applicant: KRONES Aktiengesellschaft, Neutraubling (DE)

(72) Inventors: Thomas Wimmer, Rosenheim (DE); Herbert Spindler, Niedermoosen (DE); Juergen Werner, Bruckmuehl (DE)

(73) Assignee: Krones Aktiengesellschaft, Neutraubling (DE)

( * ) Notice: Subject to any disclaimer, the term of this patent is extended or adjusted under 35 U.S.C. 154(b) by 240 days.

(21) Appl. No.: 15/514,709

(22) PCT Filed: Oct. 26, 2015

(86) PCT No.: PCT/EP2015/074740

§ 371 (c)(1),
(2) Date: Mar. 27, 2017

(87) PCT Pub. No.: WO2016/066581

PCT Pub. Date: May 6, 2016

(65) Prior Publication Data

US 2017/0233206 A1 Aug. 17, 2017

(30) Foreign Application Priority Data

Oct. 30, 2014 (DE) ..... 10 2014 222 167

(51) Int. Cl.
*B65H 19/12* (2006.01)

(52) U.S. Cl.
CPC ..... *B65H 19/123* (2013.01); *B65H 19/12* (2013.01); *B65H 2301/325* (2013.01); *B65H 2511/216* (2013.01); *B65H 2801/81* (2013.01)

(58) Field of Classification Search
CPC ..... B65H 19/12; B65H 19/123; B65H 2511/216; B65H 2801/81
See application file for complete search history.

(56) References Cited

U.S. PATENT DOCUMENTS 5,205,505 A 4/1993 Focke et al.
5,209,247 A 5/1993 Rittershaus et al.
(Continued)

FOREIGN PATENT DOCUMENTS

CN 101070124 A 11/2007
CN 202542537 11/2012
(Continued)

OTHER PUBLICATIONS

Chinese Patent Application Second Office Action dated May 3, 2018.
(Continued)

*Primary Examiner* — Sang K Kim
(74) *Attorney, Agent, or Firm* — Simmons Perrine Moyer Bergman PLC

(57) ABSTRACT

The present invention includes a method and an apparatus (1) for handling flat material and/or film material wound onto rolls (5) and that serves as packaging material for the packaging of piece goods, bundles, or the like sets of articles. Rolls (5), which are at least partially unwound, are alternately removed from at least one installation position (EB1; EB2) of a packaging machine (3), and in each case a new roll (5) of flat material and/or film material is mounted in the particular installation position (EB1; EB2). After each mounting, an externally arranged layer (15) is extracted from the particular new roll (5) near or in the area of its free end and attached to a section of a material web of a further roll (5) being guided in the packaging machine (3). This is done in a manner such that flat material and/or film material is unwound interruption-free.

17 Claims, 7 Drawing Sheets

(56) References Cited

U.S. PATENT DOCUMENTS

| | | | | |
|---|---|---|---|---|
| 5,219,127 | A | 6/1993 | Boldrini et al. | |
| 5,362,191 | A | 11/1994 | Beckmann | |
| 5,593,107 | A | 1/1997 | Focke et al. | |
| 6,604,704 | B2 | 8/2003 | Kiprowski | |
| 6,767,318 | B2 | 7/2004 | Spatafora et al. | |
| 7,246,768 | B2 | 7/2007 | Fujiwara et al. | |
| 7,832,682 | B2 | 11/2010 | Keller et al. | |
| 7,975,608 | B2 | 7/2011 | Beck et al. | |
| 7,984,603 | B2 | 7/2011 | Freudenberg et al. | |
| 8,413,407 | B2 | 4/2013 | Barsacchi | |
| 2002/0148924 | A1 | 10/2002 | Nobuta et al. | |
| 2007/0029436 | A1 | 2/2007 | Gaines et al. | |
| 2010/0154355 | A1* | 6/2010 | Freudenberg ..... | B65H 19/123 53/389.1 |
| 2015/0090831 | A1 | 4/2015 | Huber et al. | |

FOREIGN PATENT DOCUMENTS

| | | |
|---|---|---|
| DE | 102004026312 | 12/2005 |
| DE | 102008039202 | 2/2010 |
| DE | 102010028292 | 11/2011 |
| EP | 0166884 | 1/1986 |
| GB | 1184591 | 3/1970 |
| GB | 2145046 | 7/1987 |
| JP | H06001506 | 1/1994 |
| JP | 2005324909 | 11/2005 |

OTHER PUBLICATIONS

PCT/EP2015/074740—International Preliminary Report on Patentability dated May 2, 2017.
PCT/EP2015/074773—International Preliminary Report on Patentability dated May 2, 2017.
Chinese First Office Action dated Sep. 5, 2017—CN100098.
DE 10 2014 222 167.6 German Patent Application—German Search Report dated Jun. 12, 2015.
PCT/EP2015/074740 European PCT Application—International Search Report dated Feb. 2, 2016.
DE 10 2014 222 168.4 German Patent Application—German Search Report dated Jun. 23, 2015.
PCT/EP2015/074773 European PCT Application—International Search Report dated Feb. 3, 2016.
Chinese First Office Action dated Sep. 27, 2017—CN100098.

* cited by examiner

METHOD AND DEVICE FOR HANDLING FLAT AND/OR FILM MATERIAL WOUND ONTO ROLLERS

CLAIM OF PRIORITY

The present application is a national stage application of International application Ser. No. PCT/EP2015/074740, filed Oct. 26, 2015, which in turn claims priority to German Application DE 10 2014 222 167.6, filed Oct. 30, 2014, all of which are incorporated by reference.

FIELD OF THE INVENTION

The present invention relates to a method and an apparatus for handling flat material and/or film material that is wound onto rolls.

BACKGROUND OF THE INVENTION

It is common in practice to have a grouped set of articles, such as beverage containers or the like, held together by shrink film in order to be able to prevent the set from shifting or from coming undone during a transport. Bundles comprising four, six, or more containers, for example, are known from the prior art. Such bundles continue to be one of the most frequent variants of sales units for beverage container or bottles of PET plastic. It is therefore desirable to assemble such bundles as quickly as possible without interruption of individual process steps in order to be able to achieve a high throughput.

Apparatuses and methods are already known that unwind the packaging material or, as the case may be, the shrink film from one or more rolls in order to supply the material to the bundles. Hereupon, the individual bundles or, as the case may be, the particular articles provided for the bundle, are wrapped into the packaging material. The unwinding of the packaging material from the roll can be carried out by machine. Apparatuses are known, which, for example, extract the packaging material from the roll by way of rollers, with the particular roll being meanwhile rotatingly moved. After the supply of packaging material on a roll is depleted, the roll in question has to be exchanged by or replaced with a new roll. This involves an undesirable interruption of the process of assembling the bundles.

A method and an apparatus by which new reels can be supplied and depleted reels can be exchanged are known, for example, from DE 40 40 545 A1. The apparatus as known from the DE patent application has a plurality of reels arranged side by side for supplying strip material. The core of the reels is in each case positioned on a common pin. A beginning section of the strip material is previously brought into contact with a roller, which extracts the strip material from the particular reel and guides it in a downward direction away from the apparatus. In apparatuses according to the DE patent application, the reels have to be manually positioned on a common pin. In practice, it would be desirable to have apparatuses and methods by which flat material and/or film material can be provided interruption-free, where the apparatuses or, as the case may be, the methods, are to a large extent automated.

An apparatus is known from DE 10 2004 026 312 A1 with a foil splicing station where the foil web of a new roll that is mounted into a packaging machine is transferred with the support of a holding device to a sealing device. The holding device can, in particular, be formed as a manually operable clamping strip, with the aid of which a foil beginning can be extracted from a new roll and provided to a transfer device, which can supply the foil beginning to a sealing device, by which the foil beginning is heat-sealed to a foil web that is already located in the packaging machine. The clamping strip is described there as an implement that is easy to handle for bringing the foil web into an appropriate position. The clamping strip is loose, however, that is, it is not linked to the machine or to the sealing device.

DE 42 21 052 A1 discloses an apparatus for handling reels formed from wound webs of material that are primarily intended to be used as packaging material in packaging machines. For this purpose, the reels are picked up, transported, and deposited at the packaging machine by reel conveyors, which are movable above a processing machine with the aid of a reel holder engaging one reel at a time. The reel holder is to be variably adjustable relative to the reel conveyor such that it serves to bring reels to any position and to deposit them there.

In view of the known apparatuses and method, it can be regarded as a primary object of the present invention to provide an improved apparatus and an accordingly improved method for handling flat material and/or film material wound onto rolls, by which apparatus and method the flat material and/or film material can be supplied with only brief interruptions or, ideally, at least approximately interruption-free, and which apparatus and method moreover enable a high degree of automation.

SUMMARY OF THE INVENTION

The above objects are fulfilled by an apparatus and a method comprising the features in the independent claims. Further advantageous embodiments of the invention are described in the relevant dependent claims.

The invention relates to a method for handling flat material and/or film material that is wound onto rolls and that serves as packaging material for the packaging of piece goods, bundles, or the like sets of articles. The flat material and/or film material can therefore be formed as shrink film, for example, or made from another film material or flat web material. The rolls can have a core in a geometric form corresponding to a hollow cylinder and at least partly consisting of a cellulosic material. Advantageously, each particular new roll can hereby be positioned on a pin of the packaging machine, the pin corresponding with the core, and the roll can rotatingly revolve on the pin when packaging material is being extracted or, as the case may be, is being removed from the roll.

In the course of the method, rolls, which are at least partially unwound and/or depleted, are, for the purpose of maintaining a packaging operation, removed from at least one installation position of a packaging machine, and in each case a new roll of flat material and/or film material is hereupon mounted in the particular installation position. As already mentioned above, each installation position can have a pin, on which the new roll is positioned, and on which the particular roll rotates for the purpose of unwinding its particular flat material and/or film material. In particular, the rolls can be clampingly fixed on the pin of their particular installation position. The pin can be rotationally driven and can transmit a torque to the particular roll mounted on it such that the roll is rotatingly moved by way of its pin to unwind its flat material and/or film material. Each pin can be associated with a drive, by way of which the particular pin is rotated. The drives can be linked to a control unit described in more detail below or, as the case may be, they can be activated to rotate the pins by way of a control unit described in more detail below. Before removing a roll with at least partially unwound and/or depleted packaging material from its particular installation position, the clamping connection between the pin and the roll can be undone such that the roll is no longer fixedly linked to the pin and can be removed from the pin. The rotating movement of the pin can be interrupted until a new roll has been positioned on the pin or, as the case may be, until it has been mounted in the corresponding installation position.

For the purpose of maintaining an approximately continuous packaging operation, rolls, which are at least partially unwound and/or depleted, can in the course of the method be typically alternately removed from at least two different installation positions of the packaging machine, and in each case a new roll of flat material and/or film material can be hereupon mounted in the particular installation position. As already mentioned above, each of the at least two installation positions can have a pin, on which the new roll is positioned, and on which the particular roll rotates for the purpose of unwinding its particular flat material and/or film material. While the rolls are being replaced, the packaging operation can be interrupted or, as the case may be, it can continue uninterrupted. The above-mentioned variant with only one installation position for a roll, however, only enables an uninterrupted packaging operation during roll replacement if an additional storage for flat material and/or film material is provided, out of which this material can be conveyed and supplied to the packaging operation during roll replacement.

The method generally enables an interruption-free handling of flat material and/or film material that is wound onto rolls and that serves as packaging material for piece goods, bundles, or the like sets of articles, such that a continuously ongoing packaging operation can be therewith maintained. For this purpose, however, at least two different installation positions for one roll of flat material and/or film material each are required such that the roll, which is located in one installation position, can be continuously unwound, while the respectively other installation position is available for roll replacement and for the supply of new flat material and/or film material, such that—according to the design of the processes of replacing and attaching, of bonding or heat-sealing—a continuous or, as the case may be, a quasi-continuous packaging operation can be maintained during roll replacement. The method according to the invention relates likewise to handling flat material and/or film material wound onto rolls within a packaging process both where such a handling is interruption-free and where it is briefly interrupted. Since the method also relates to a handling method involving the use of only one installation position within the packaging machine, it becomes clear that a continuous or, as the case may be, an uninterrupted packaging operation is only possible with the help of an intermediate storage or another support measure, because the conveying process of film material or, as the case may be, flat material has to be interrupted at least during roll replacement.

After each mounting of a new roll in its particular installation position, an externally arranged layer is extracted from the particular new roll near or in the area of its free end and, for the purpose of forming an uninterrupted material web, is attached to a section of a material web of a further roll being guided in the packaging machine.

In particularly preferred embodiments, it is possible that the externally arranged layer of the particular mounted new roll is extracted by a gripping device and/or handling device operating with pneumatic suction pressure, in a mechanically clamping manner, and/or by electrostatic adhesion, with the gripping device and/or handling device moving back and forth between the at least two installation positions. The gripping device and/or handling device can thus extract externally arranged layers of the new rolls alternately from the at least two installation positions. In practice such embodiments have proved successful in which the gripping device and/or handling device temporarily fixes in place the particular externally arranged layer of the new roll using negative pressure.

Furthermore, a sealing bar can be provided, which is moved downward and in the process heat-seals the externally arranged layer of the particular new roll to the material web being guided in the packaging machine. The externally arranged layer in question can be moved into the operating range of the sealing bar by way of the gripping device and/or handling device. The temperature-controlled sealing bar can thus move the externally arranged layer of the new roll in question in a clamped manner against the material web being guided in the packaging machine. Such embodiments have proved particularly successful in which the sealing bar is moved vertically up and down for this purpose and in a vertical downward movement heat-seals the particular externally arranged layer of a new roll to a material web being guided in the packaging machine.

Preferably, the flat material and/or film material of the further roll is not yet completely depleted while a new roll is being mounted and while the material web is being attached, such that flat material and/or film material is being unwound interruption-free for the continuous packaging operation from at least one roll of the at least one installation position or, as the case may be, from the two installation positions. Advantageously, the new roll can accordingly be mounted while flat material and/or film material is being unwound from the further roll in the packaging machine. Even while an at least approximately completely unwound and/or depleted roll is being removed from the packaging machine, flat material and/or film material can be unwound from a further roll of the packaging machine such that flat material and/or film material is unwound continuously and interruption-free from at least one roll positioned in the packaging machine. It should be emphasized here, however, that the interruption-free or, as the case may be, the continuous packaging operation represents a special case, while the method according to the invention likewise relates to the case of the packaging operation that is briefly interrupted for roll replacement.

In the context of the method according to the invention, rolls of the at least two installation positions, which rolls are at least approximately completely unwound and/or depleted, are furthermore preferably sensor-detected and replaced by a handling device with new rolls of flat material and/or film material. Sensor detection can be carried out, for example, with the help of optical detectors or, as the case may be, of an optical detection system that can be arranged in the area of the installation positions. The optical detection system or, as the case may be, the optical detector and the handling device can be linked to a control unit. Sensor detection can optionally also be carried out with the help of tactile detectors or, as the case may be, of a tactile, that is, of a touch detection system, which can be arranged in the area of the at least one installation position. The detection system or, as the case may be, the tactile or, as the case may be, the touch detector and the handling device can be linked to a control unit. Furthermore, sensor detection can also be carried out with the help of ultrasonic detectors or, as the case may be, of an ultrasonic detection system, which can be arranged in the area of the installation positions for the rolls with flat material and/or film material wound thereonto. The detection system or, as the case may be, the ultrasonic detector and the handling device can in turn be linked to the mentioned control unit.

Moreover, the direction of rotation and/or the rotation-direction-conforming orientation of the new rolls can be determined and/or verified while or after they are mounted. In practice such embodiments have proved particularly successful in this context, in which the determination and/or the verification of the direction of rotation and/or of the rotation-direction-conforming orientation is carried out by optical, tactile, or ultrasonic-based capture or, as the case may be, also in a different manner. The invention is, however, not limited to suchlike exemplary embodiments so that haptic, tactile, and/or further mechanisms, for example, can also be provided for verifying the direction of rotation and/or the rotation-direction-conforming orientation of the particular new roll.

If the detected direction of rotation and/or the detected rotation-direction-conforming orientation is appropriate or, as the case may be, if it corresponds to a predetermined target orientation and/or to a target direction of rotation, the particular new roll can be mounted in its associated installation position or, as the case may be, remain in its particular associated installation position. If a wrong direction of rotation and/or a non-rotation-direction-conforming positioning is determined, an alignment correction of the particular new roll can be performed or a further new roll with appropriate direction of rotation and/or rotation-direction-conforming orientation can be selected for mounting and can be mounted in the particular installation position.

It is for instance possible that a direction of rotation and/or a rotation-direction-conforming positioning of a new roll that has already been mounted in its particular installation position is verified and/or determined. If a wrong direction of rotation and/or a non-rotation-direction-conforming positioning is determined, the particular new roll can be removed from the packaging machine, can be oriented or, as the case may be, aligned rotation-direction-conformingly or, as the case may be, with appropriate direction of rotation, and can subsequently be again mounted in its particular installation position. The rotation-direction-conforming orientation or, as the case may be, the orientation with the appropriate direction of rotation as well as the repeated mounting of the roll in its particular installation position can then be carried out before attaching or, as the case may be, before heat-sealing its externally arranged layer to the material web still remaining in the packaging machine. During the rotation-direction-conforming alignment of the new roll, flat material and/or packaging material can be continuously unwound from a further roll arranged in the packaging machine or, as the case may be, arranged in one of the at least two installation positions.

Alternatively, however, an additional pulley can also be used, which makes it possible to leave rolls in place that would normally have to be turned around, and to guide the flat material and/or film material being unwound from these rolls over this optionally applicable pulley in order to adapt the flat web guidance to the required processing direction in the packaging machine. If the roll with the flat material and/or film material wound onto it has been mounted in the appropriate direction of rotation, however, this additional pulley is not required so that it can be shifted or deactivated or also removed from its place by machine, as the case may be.

It is also conceivable that a direction of rotation and/or a rotation-direction-conforming positioning of a new roll is verified and/or determined before it is mounted in its particular installation position. If a wrong direction of rotation and/or a non-rotation-direction-conforming positioning is then determined or, as the case may be, verified, there is the possibility of verifying or, as the case may be, of determining the direction of rotation and/or the rotation-direction-conforming positioning of a further roll and of mounting this roll in the installation position if it has the appropriate direction of rotation and/or rotation-direction-conforming positioning. Alternatively, the new roll can be brought into an appropriate rotation-direction-conforming orientation or, as the case may be, into an appropriate direction of rotation and can then be mounted in the particular installation position.

It is furthermore possible that the handling device has at least one detector, in particular an optical detector, and preferably a camera system, which is moved by way of the handling device into the area of the new rolls, with the direction of rotation and/or the rotation-direction-conforming orientation of the new rolls being verified by the optical detector or, as the case may be, by the optical detector. Other detector concepts are optionally also suitable for the required purpose of application, for example ultrasonic detectors or tactilely operating detectors.

In particularly preferred embodiments of the present invention, the previously already described handling device can be in operative connection with the detector or, as the case may be, with the optical detector, for the purpose of receiving new rolls with the appropriate direction of rotation or, as the case may be, with the appropriate rotation-direction-conforming orientation. Receiving a new roll with rotation-direction-conforming orientation or, as the case may be, with appropriate direction of rotation by way of the handling device as well as subsequent mounting in the particular installation position of the roll can thus be carried out fully automatically. The handling device can, for instance, be coupled to the detector or, as the case may be, to the optical detector by way of a control unit.

In particular, it can be provided that the rolls are rotatingly moved in the installation position, in each case with the same direction of rotation, for the purpose of unwinding the packaging material. If the rolls are positioned alternately in two installation positions, it can also be provided that the rolls are rotatingly moved with the same direction of rotation in all of the at least two installation positions for the purpose of unwinding the packaging material.

It is also conceivable that in each case at least one optical marker, in particular at least one reflective marking, is applied onto a section of the new rolls in the area of their free ends. In this context it is possible that the optical detector determines and/or verifies the direction of rotation and/or the rotation-direction-conforming orientation of the new roll by the optical marker. The optical marker can be formed as an adhesive label and it can be glued or, as the case may be, attached by surface adhesion onto the section of the new rolls in the area of their free ends. In particular, at least two optical markers or, as the case may be, at least two reflective markings can be provided for each free end of a new roll. If other than optical capture systems are applied, it can be useful to arrange suchlike detectable markers on the rolls, for example such markers as can be detected by ultrasonic capture devices or by tactile capture devices.

It is moreover conceivable that the handling device mounts the new rolls in their particular installation position, or that the new rolls are aligned in their particular installation position before extracting the particular outer layer, such that the optical markers face toward an in each case oppositely located installation position. An aligning of the new rolls in their particular installation position can be carried out, for example, by rotating a pin on which the particular new roll is positioned in its installation position, by less than 360° The optical detector and the rotating pin can be linked to a control unit, which controls a rotation of the particular pin by less than 360° for the purpose of aligning the new rolls in consideration of a particular position of the optical marker determined by the optical detector.

It is furthermore possible that the at least one marker or, as the case may be, the at least one optical marker is applied onto the particular new roll before it is mounted in its particular installation position such that the free end of the particular new roll is at least largely immovably fastened to the particular new roll by the marker. Since the free end is hereby immovably fastened to the particular new roll, its externally arranged layer can simply be extracted near or in the area of its free end after that particular new roll has been mounted. As already mentioned, the extraction can be carried out by a gripping device and/or handling device, for example, which preferably mechanically fixes or, as the case may be, grips the externally arranged layer of the new roll in the area of its free end and hereupon moves away from the new roll in order to extract the externally arranged layer from the particular new roll.

The optical detector can moreover be moved into the area of the particular new roll by way of the handling device and can there detect the particular optical marker of the new roll for the purpose of verifying and/or determining the direction of rotation and/or the rotation-direction-conforming positioning of the new roll. In particular, the optical detector can be formed as a camera system, which is linked to a control unit. If other sensor systems or, as the case may be, other sensor concepts are used, the detector used in each case can be moved into the area of the particular new roll by way of the handling device and can there detect the particular capturable marker of the new roll for the purpose of verifying and/or determining the direction of rotation and/or the rotation-direction-conforming positioning of the new roll. In particular, the detector can be formed as an ultrasonic capture system or as a tactile capture system, which is linked to a control unit.

There are moreover conceivable embodiments in which the handling device has a retaining mandrel, which dips into the face side of the new roll, which is designed as hollow body, hereupon increases its maximum cross-sectional diameter and hereby clampingly fixes the particular new roll to the handling device. The optical detection system can be arranged in the area of the retaining mandrel such that first a verification or, as the case may be, a determination of the direction of rotation and/or of the rotation-direction-conforming positioning of a particular new roll can be carried out and subsequently, in prompt consecutive steps, the particular new roll, in the instance of appropriate direction of rotation and/or of rotation-direction-conforming positioning, is picked up by the retaining mandrel of the handling device by way of increasing the mandrel's maximum cross-sectional diameter.

The longitudinal extension of the retaining mandrel can be formed to be less in comparison to the longitudinal extension of the hollow core of the new rolls such that the particular new roll can be slid onto one of the pins associated with the particular installation position of the packaging machine with the retaining mandrel engaging into the core. The cross-sectional diameter of the retaining mandrel can hereafter be decreased such that the clamping connection between the retaining mandrel and the particular new roll comes undone. The handling device or, as the case may be, the retaining mandrel of the handling device, can then be guided toward a further new roll while the new roll that has been mounted in the particular installation position by way of the handling device is non-rotatingly positioned on the associated pin. For the purpose of producing the non-rotating connection between the pin and the particular roll positioned on the pin, it is also possible to increase the cross-sectional diameter of the pin.

Furthermore, the new rolls can be mounted in their particular installation position in such a manner that after being mounted their free ends are oriented toward an oppositely located installation position of the at least two installation positions. For this purpose it can be provided, for instance, that the at least one optical marker, which has been applied onto a section of the new rolls in the area of their free ends, is detected by the optical detector or, as the case may be, by the optical detection system, an according information is transmitted to a control unit, and the control unit activates the handling device such that, after the new rolls have been mounted, the free ends are oriented toward an in each case oppositely located installation position of the at least two installation positions. In addition, it can optionally be provided that the at least one marker, which has been applied onto a section of the new rolls in the area of their free ends, is detected by the detector or, as the case may be, by the detection system, an according information is transmitted to a control unit, and the control unit activates the handling device such that, after the new rolls have been mounted, the free ends are oriented toward an in each case oppositely located installation position of the at least two installation positions.

In further embodiments it is conceivable that the detector or, as the case may be, the optical detector or, as the case may be, the optical detection system is arranged in the area of the at least two installation positions and, after a particular new roll has been mounted, it detects an orientation of the at least one optical marker and transmits the according information to the control unit. The control unit can further cause a rotation of the pin, on which the new rolls are positioned, such that the free ends or, as the case may be, the sensor-capturable markers or, as the case may be, the optical markers of the new rolls face toward the in each case oppositely located installation position of the at least two installation positions.

It is moreover possible that the new rolls are moved into the area of the handling device by way of a horizontal conveying device, are supplied to the handling device, and are removed directly from the horizontal conveying device by the handling device. The horizontal conveying device can be formed as a circulating, endless conveyor belt. A manipulator can be positioned at the beginning or on the side of a conveyor line section of the horizontal conveying device, by which manipulator new rolls can be positioned preferably standing upright onto the horizontal conveying device. The manipulator can also have a retaining mandrel, which is inserted into new rolls on their face side or, as the case may be, into a core of the new rolls, and which grips the new rolls by way of increasing its cross-sectional diameter. It can be provided, in particular, that the manipulator is manually operable and that a positioning of new rolls is carried out by the manipulator by a user.

It is also conceivable that a control unit is linked to the handling device and to the horizontal conveying device and that it controls a clocked operation of the horizontal conveying device in consideration of a removal of new rolls from the horizontal conveying device carried out by the handling device. In this way, the handling device can immediately access new rolls if required and without manned support, whereby the degree of automation can be further increased.

The invention moreover relates to an apparatus for handling flat material and/or film material that is wound onto rolls and that serves as packaging material for the packaging of piece goods, bundles, or the like sets of articles. It should be noted here that various features pointed out above in the context of embodiments of the method according to the invention can likewise be provided for conceivable embodiments of the apparatus according to the invention. Furthermore, features pointed out below in the context of conceivable embodiments of the apparatus according to the invention can be provided for various embodiments of the method according to the invention.

The apparatus is provided for handling flat material and/or film material that is wound onto rolls and that serves as packaging material for the packaging of piece goods, bundles, or the like sets of articles. The apparatus has a packaging machine with at least one installation position or, as the case may be, with at least two different installation positions, each of which are provided for the rotating reception of rolls of flat material and/or film material. A further part of the packaging machine are one or more coupling devices, which are formed for aligning and attaching free end sections of flat material and/or film material of the new rolls mounted in the at least two installation positions each to a material web, which is already moving in the packaging machine, of a further roll, which is already located in the packaging machine at the time of mounting. It is thus possible to continuously unwind flat material and/or film material from at least one roll located in the packaging machine or, as the case may be, from at least one roll of the at least two installation positions, thus making it possible to ensure a continuous packaging operation.

It should be additionally noted that the at least one installation position for the rolls with flat material and/or film material wound thereonto or, as the case may be, the typically two installation positions with their rotatable retaining means for the rolls of flat material and/or film material can be designed to be height-adjustable, for instance, in order to be able to carry out an adaptation to different roll diameters and/or a correction of the conveying paths with gradually depleting material supply of a roll, which is being unwound and which therefore gradually decreases in diameter.

As part of the one or more coupling devices there can be a sealing bar, for example, as well as a gripping device and/or handling device such a guide rod, and since these have already been described above, their function and their design are not mentioned again below.

The apparatus according to the invention moreover has at least one sensor system by way of which rolls of the at least two installation positions are detectable, which rolls are at least approximately completely unwound and/or depleted. The sensor system can be formed, for example, as an optical detection system or, as the case may be, as an optical detector, optionally also as an ultrasonic detection system or as a tactilely operating detection system. A detection range of the sensor system can extend across the at least two installation positions.

The apparatus according to the invention furthermore has a control unit coupled to the sensor system, with the handling device being activatable by the control unit when the roll is at least approximately completely unwound and/or depleted, for the purpose of the autonomous replacement of the roll, which is at least approximately completely unwound and/or depleted, with a new roll.

In conceivable embodiments, the apparatus can have an optical detector or, as the case may be, an optical detection system, which is formed for verifying and/or determining a direction of rotation and/or rotation-direction-conforming orientation of new rolls, which are each provided for the at least two installation positions. The optical detection system or, as the case may be, the optical detector can comprise at least one camera system.

It is conceivable, for instance, that the optical detector or, as the case may be, the optical detection system is in an operative connection with the handling device by way of the control unit, with a particular direction of rotation and/or rotation-direction-conforming orientation of new rolls being verifiable and/or determinable by way of the optical detector or, as the case may be, by way of the optical detection system, and with the new rolls being mountable by the handling device with the direction of rotation and/or rotation-direction-conforming orientation that is in each case appropriate for the particular installation position, and/or with the new rolls being alignable by the handling device with the appropriate direction of rotation and/or rotation-direction-conforming orientation.

It is conceivable, for instance, that the apparatus has an optical display unit coupled with the control unit, such as for example a display or the like, by way of which information on the direction of rotation and/or on the rotation-direction-conforming orientation can be shown. It is possible, for example, that a note for a user is output via the optical display unit when the new rolls have a wrong direction of rotation or, as the case may be, a non-rotation-direction-conforming orientation. It is also conceivable that information on the direction of rotation and/or on the rotation-direction-conforming orientation is output as an acoustic signal.

In the instance of new rolls with the appropriate direction of rotation and/or rotation-direction-conforming orientation, initialization can be carried out under operative connection of the control unit with a handling device, or the handling device can be activated to mount a particular new roll with the appropriate direction of rotation and/or rotation-direction-conforming orientation, as the case may be. If an appropriate direction of rotation or, as the case may be, rotation-direction-conforming orientation is determined and/or verified, it can be provided, for example, that the handling device picks up the particular new roll and moves it toward one of the at least two installation positions.

Alternatively, an additional pulley can also be used, which makes it possible to leave rolls in place that would normally have to be turned around, and to guide the flat material and/or film material being unwound from these rolls over this optionally applicable pulley in order to adapt the flat web guidance to the required processing direction in the packaging machine. If the roll with the flat material and/or film material wound onto it has been mounted in the appropriate direction of rotation, however, this additional pulley is not required so that it can be shifted or deactivated or also removed from its place by machine, as the case may be.

In particular, it is possible that the control unit is linked to a handling device, by which rolls with at least partially unwound and/or depleted flat material and/or film material are autonomously removable from the particular installation position and new rolls with the appropriate direction of rotation and/or the appropriate rotation-direction-conforming orientation are autonomously mountable in the at least two installation positions. In this context, an algorithm can be stored in the control unit such that a specific activation of the handling device is effected by way of the algorithm in consideration of the direction of rotation and/or of the rotation-direction-conforming orientation of the particular new roll as determined by the optical detector.

Moreover, the handling device can comprise a preferably cylindrically formed retaining mandrel with an adjustable maximum cross-sectional diameter for the purpose of the clamping fixation of the new rolls, which are formed as hollow bodies. The adjustment of the cross-sectional diameter can be carried out by way of the control unit or, as the case may be, can be specified by the control unit. The handling device can have a movable gripping arm with the retaining mandrel being arranged at the free end of the gripping arm.

In particularly preferred embodiments it is possible that a horizontal conveying device that is designed for the transport of new rolls is arranged upstream of the handling device, which horizontal conveying device extends into an operating range of the handling device and which is activatable in clocked operation by way of the control unit in consideration of a removal of new rolls by the handling device. It is conceivable that in further embodiments new rolls are supplied to the handling device on pallets or the like. It is also possible to place new rolls in a container or the like, which is located in the operating range of the handling device, and by way of which new rolls are supplied to the handling device. The new rolls can be placed into the container unsorted or, as the case may be, in random orientation, with the direction of rotation and/or the rotation-direction-conforming orientation being verifiable and/or determinable by the optical detector.

The detector or, as the case may be, the optical detector can also be in a mechanically coupled connection to the handling device and can be movable by way of the handling device toward the particular new rolls provided for the at least two installation positions. The optical detector or, as the case may be, the optical detection system can here be arranged in the area of a free end of a gripping arm of the handling device. Furthermore, the already described retaining mandrel can be arranged in the area of a free end of a gripping arm of the handling device. The optical detection system or, as the case may be, the optical detector and the retaining mandrel can thus be moved together through the handling device to the particular new roll. In conceivable embodiments of the apparatus according to the invention, the optical detector or, as the case may be, the optical detection system can also be designed as a camera system.

The packaging machine can moreover have at least one stationary detection system or, as the case may be, at least one stationary detector in the area of the at least one installation position, in particular in the area of the two installation positions, with the direction of rotation and/or the rotation-direction-conforming orientation of the particular new rolls mounted in the at least two installation positions being determinable and/or verifiable by way of the detection system or, as the case may be, by way of the stationary detector. The stationary detection system or, as the case may be, the stationary detector can also be designed as a camera system. In this context it is conceivable that the apparatus has at least one stationary detection system or, as the case may be, one stationary detector in the area of the at least two installation positions and also has a detector that is mechanically coupled to the handling device or, as the case may be, a detection system that is coupled to the handling device. In further embodiments, the apparatus can have merely a stationary detection system or, as the case may be, a stationary detector, or a detection system that is mechanically coupled to the handling device or, as the case may be, a detector that is mechanically coupled to the handling device.

The coupling means can have, in particular, at least one gripping device and/or handling device, which is movable back and forth between the at least two installation positions, by which gripping device and/or handling device the free end sections of flat material and/or film material of new rolls are temporarily grippable with pneumatic suction pressure, in a mechanically clamping manner, and/or by electrostatic adhesion.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

FIG. 1 moreover illustrates a conceivable implementation of an embodiment for the method according to the invention;

FIG. 2 moreover illustrates a further conceivable implementation of an embodiment for the method according to the invention;

DETAILED DESCRIPTION OF THE INVENTION

Figure 1:
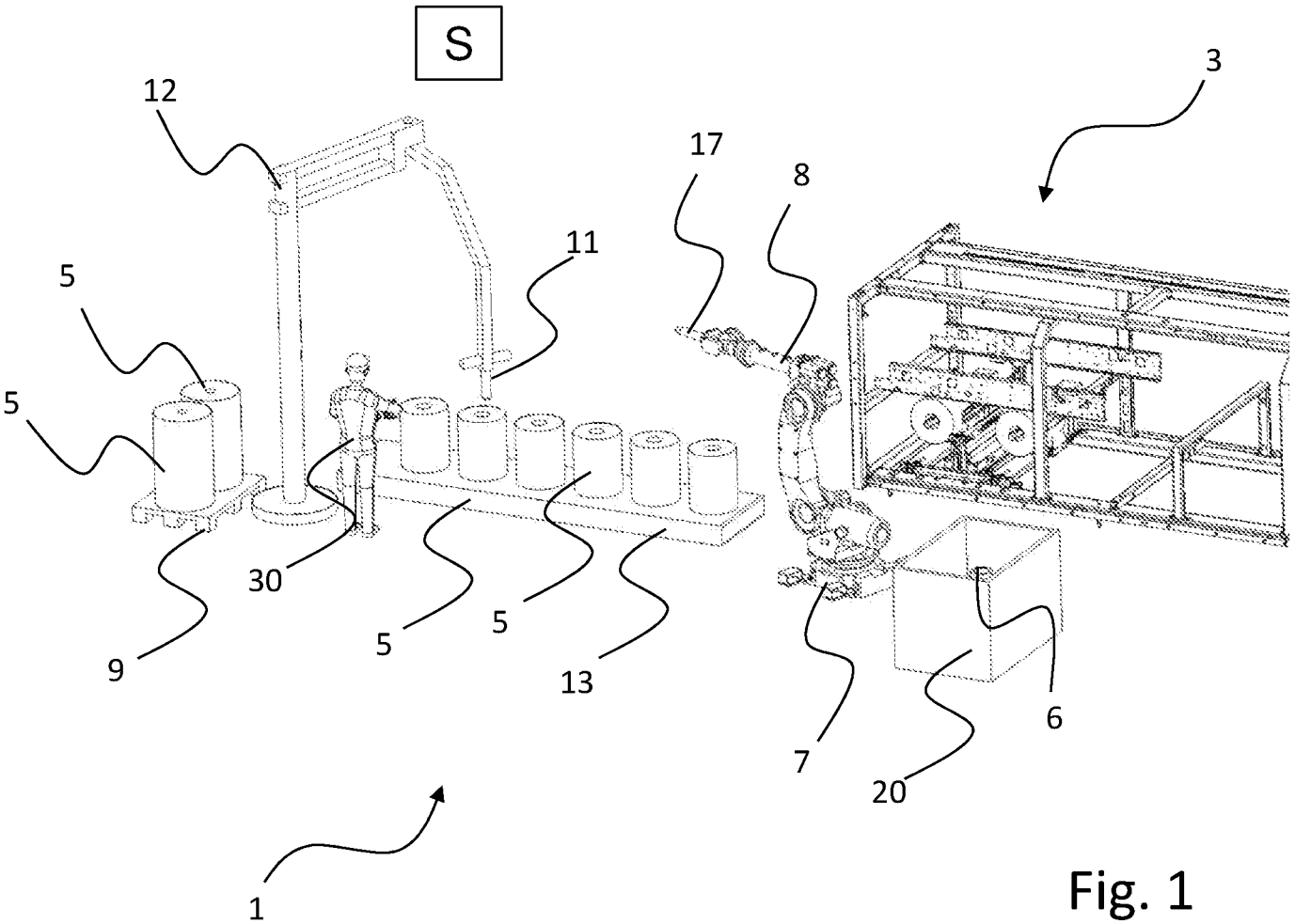
FIG. 1 shows a schematic perspective view of a first embodiment of an apparatus according to the invention.

The same or equivalent elements of the invention are designated by identical reference characters. Furthermore and for the sake of clarity, only the reference characters relevant for describing the respective figure are provided. It should be understood that the detailed description and specific examples of the embodiments of the apparatus or of the method according to the invention are intended for purposes of illustration only and are not intended to limit the scope of the invention.

FIG. 1 shows a schematic perspective view of a first embodiment of an apparatus 1 according to the invention. FIG. 1 moreover illustrates a conceivable implementation of an embodiment for the method according to the invention.

The apparatus 1 serves for handling packaging material or, as the case may be, shrink film that is wound onto rolls 5. A packaging machine 3 being supplied new rolls 5 by way of a handling device 7 are discernible in FIG. 1. The handling device 7 mounts the particular new rolls 5 in two different installation positions EB1 and EB2, which are only rudimentarily discernible in FIG. 1 and are exemplarily illustrated in the detailed view of FIG. 3.

It should be emphasized here, however, that the packaging machine 3 can optionally also have only one installation position EB1 or EB2 such that a roll replacement will almost mandatorily involve an interruption of the packaging operation.

Figure 3:
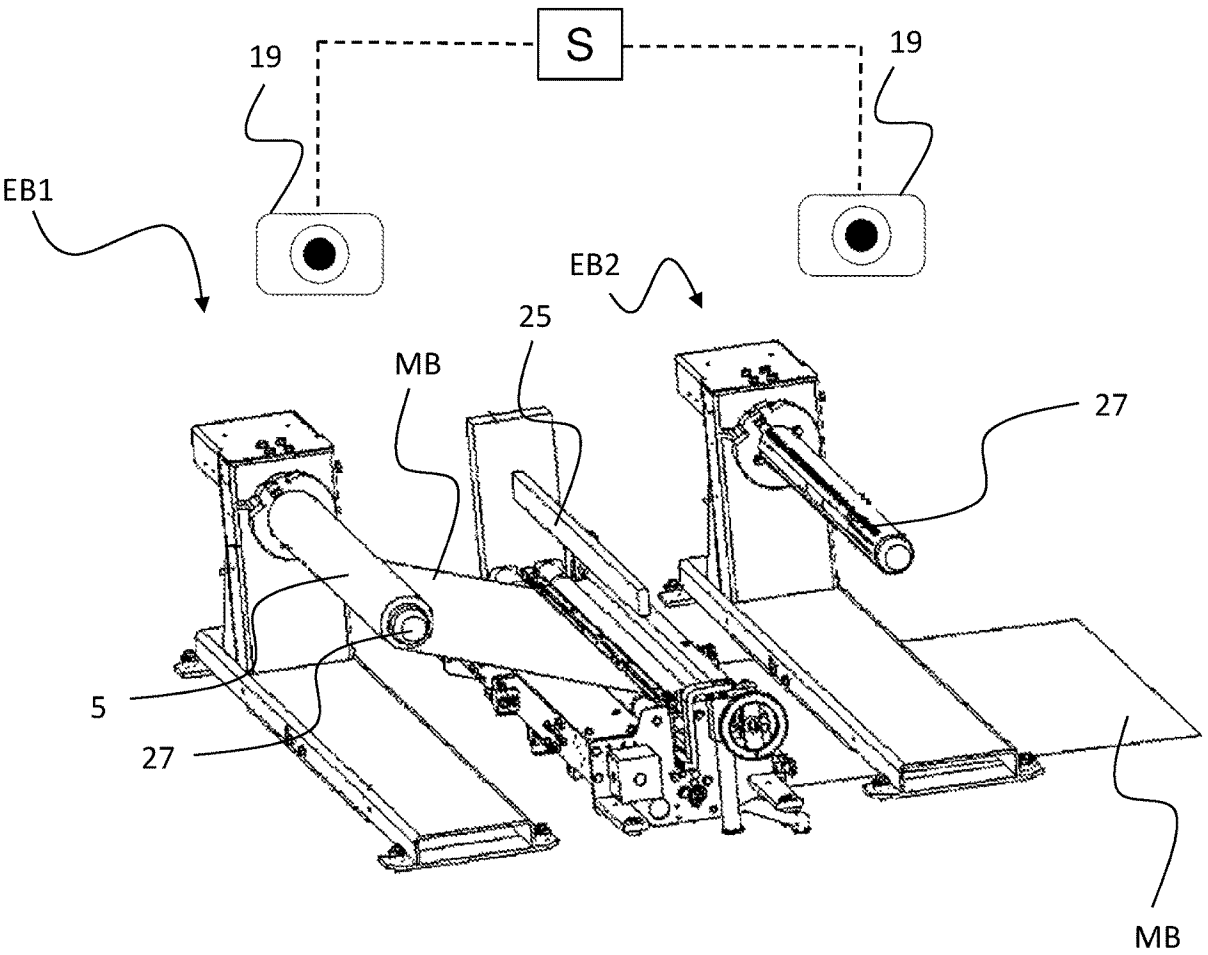
FIG. 3 shows a schematic perspective view of two installation positions as can be provided for an apparatus according to the exemplary embodiments from FIGS. 1 and 2.
Figure 4:
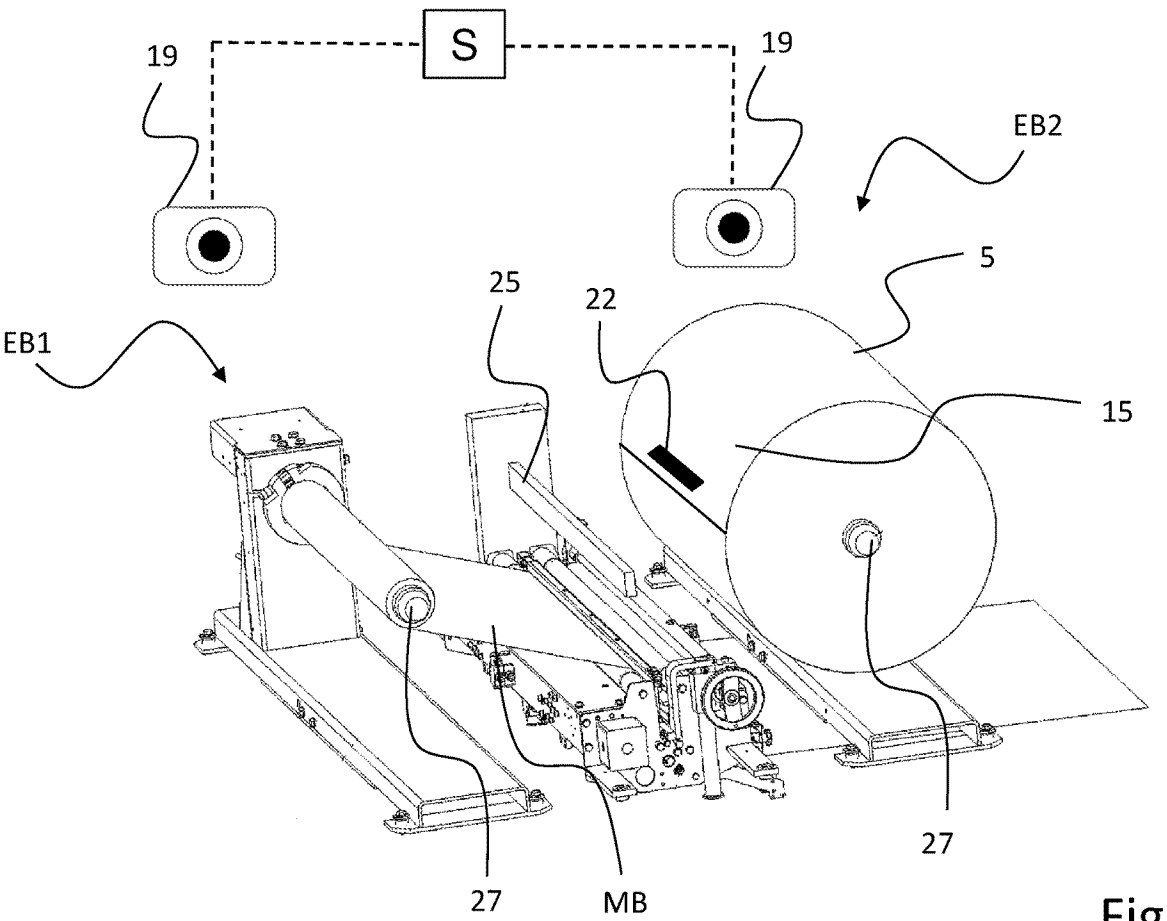
FIG. 4 shows the installation positions of FIG. 3 with a mounted new roll for the second installation position.
Figure 5:
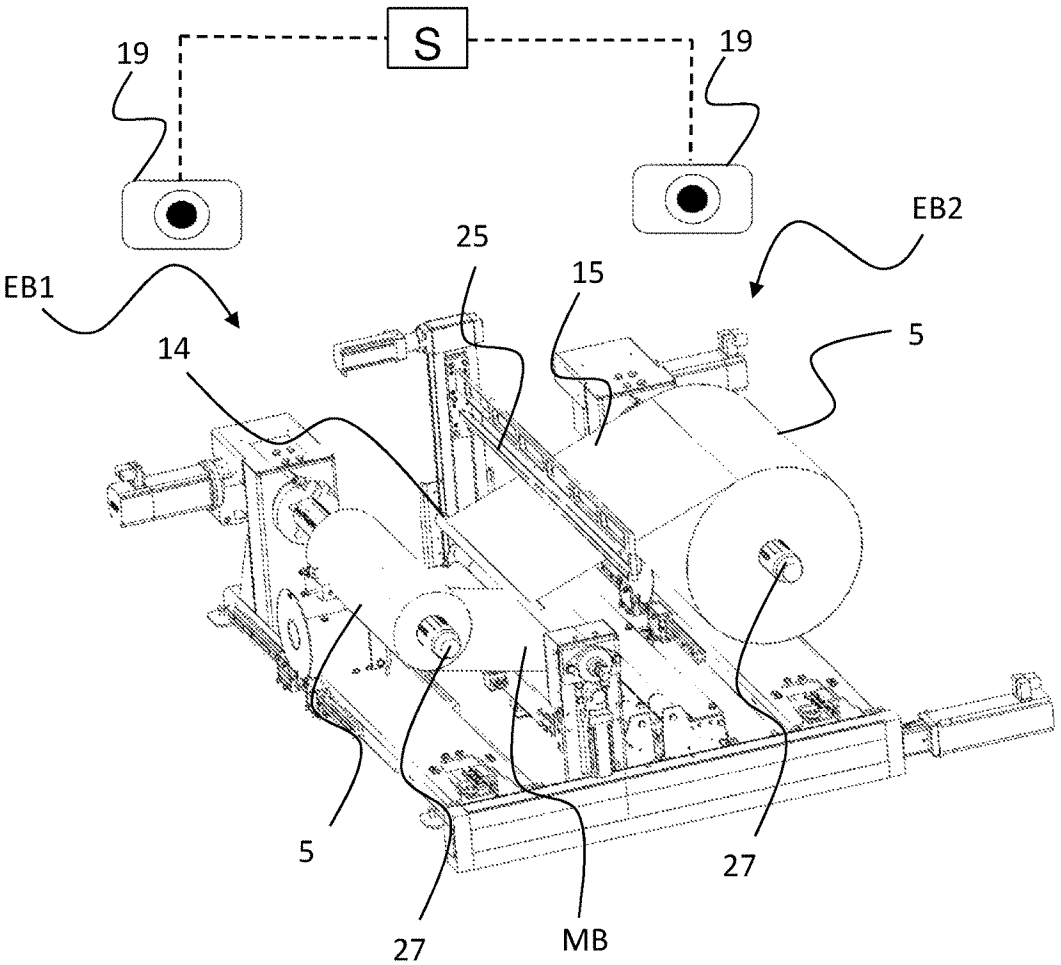
FIG. 5 shows the installation positions of FIGS. 3 and 4 with extracted outer layer of the new roll mounted in the second installation position.

As shown in a synopsis of FIGS. 3 to 5 with FIG. 1, a new roll 5 is mounted in one of the two installation positions EB1 or EB2, as the case may be, by way of the handling device 7, while a roll 5 is still located in the other installation position EB1 or EB2, as the case may be, from where a material web MB is unwound during the mounting of the new roll 5. While the material web MB continues to be unwound from the nearly depleted roll 5, the outer layer 15 (cf. FIG. 5) of the new roll 5 is heat-sealed to the material web MB such that the apparatus 1 can hereby be continuously operated without the necessity of interrupting the process for replacing a depleted roll 5.

The new rolls 5 are composed of packaging material or, as the case may be, of shrink film, as well as of a core 6, onto which the packaging material or, as the case may be, the shrink film is wound. For taking a new roll 5 from the horizontal conveying device 13, the handling device 7 dips into a core 6 on the face side of the new roll by way of a retaining mandrel 17. For this purpose, a gripping arm 8 of the handling device 7 can be rotatingly moved about an axis of rotation 16 as is exemplarily shown in FIG. 6 of the present patent application. After the retaining mandrel 17 dips into the core 6, the cross-sectional diameter of the retaining mandrel 17 is increased such that the new roll 5 is clampingly fixed to the retaining mandrel 17, as is also shown in FIG. 7. The core 6 is formed as a hollow cylinder, with the form of the retaining mandrel 17 corresponding hereto such that the retaining mandrel 17 is linked by way of its outer circumference to an inner cover surface of the core 6 for the purpose of clampingly fixing the new roll 5.

New rolls 5 are supplied to the handling device 7 by way of the horizontal conveying device 13 such that another new roll 5 is moved further toward the handling device 7 or, as the case may be, moves up toward the handling device 7 when a new roll 5 is removed from the horizontal conveying device 13. The horizontal conveying device 13 can thus be operated in a clocked manner or continuously at a constant speed. The operation is specified by the control unit S.

Also discernible is a manipulator 12 positioned in the area of the horizontal conveying device 13, which manipulator 12 is operated by a user 30, and by which manipulator 12 new rolls 5 are placed standing upright onto the horizontal conveying device 13. The new rolls 5 stand on a pallet 9, from which the user 30 takes them by the manipulator 12 and places them onto the horizontal conveying device 13. An operating range of the manipulator 12 therefore extends across the pallet 9 as well as across a conveyor line section of the horizontal conveying device 13.

Further illustrated is a container 20, which is located in the operating range of the handling device 7. When the supply of packaging material or, as the case may be, of shrink film of one of the rolls 5 placed in the packaging machine 3 is depleted, the cellulose or plastic core 6 of an empty roll 5 is removed from the packaging machine 3 and deposited in the container 20 by the handling device 7. Only after removing the core 6 can a new roll 5 be mounted in the particular installation position EB1 or EB2, as the case may be, of the packaging machine 3 such that the handling device 7 first removes the core 6 and in temporal succession mounts a new roll 5 in the particular installation position EB1 or EB2, as the case may be.

The horizontal conveying device 13, the handling device 7, and the packaging machine 3 are linked to a control unit S. In the present instance, the control unit S controls the clocked operation of the horizontal conveying device 13, initiates rolls 5 to be mounted in and removed from the two installation positions EB1 and EB2 by the handling device 7, and controls an unwinding of packaging material or, as the case may be, of shrink film from the rolls 5 mounted in the packaging machine 3, as is described in more detail below.

The control unit S has a display or is moreover linked to a display, which is not illustrated here, by way of which information on the direction of rotation or, as the case may be, on the rotation-direction-conforming orientation of new rolls 5 are output in a manner visible to a user 30. As described below for the FIGS. 3 to 7, the direction of rotation or, as the case may be, the rotation-direction-conforming orientation of the new rolls 5 is determined and/or verified by a camera 19 or 21, as the case may be, which is linked to the control unit S. Since the handling device 7 can remove the particular core 6 of an empty roll 5 from the packaging machine 3, and, supported by the cameras 19 or 21, as the case may be, autonomously mounts new rolls 5 in the packaging machine 3 with appropriate direction of rotation or, as the case may be, rotation-direction-conforming orientation, the apparatus 1 can be operated completely automated at least from the point of taking new rolls 5 from the horizontal conveying device 13.

Figure 2:
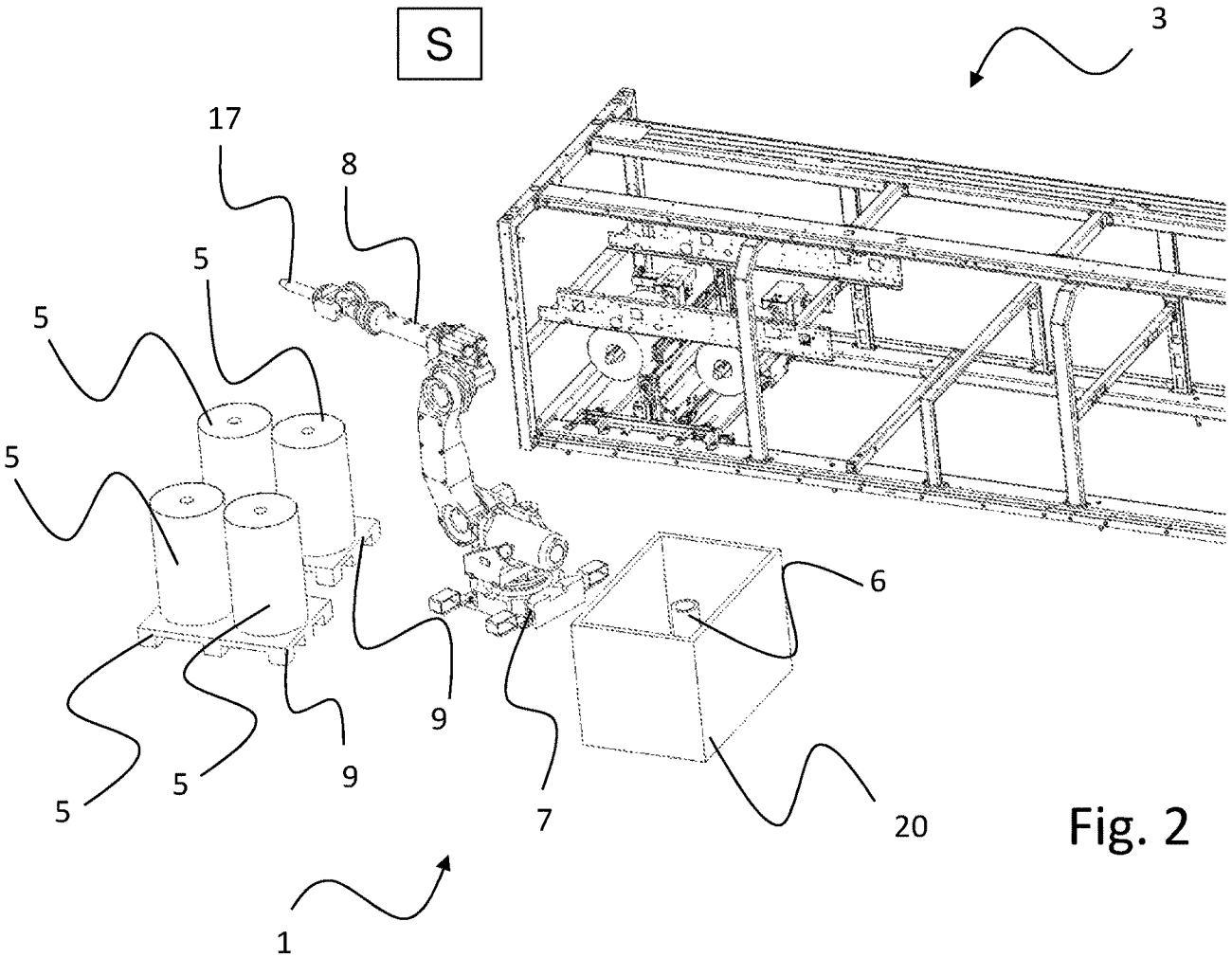
FIG. 2 shows a schematic perspective view of a further embodiment of an apparatus according to the invention.

FIG. 2 shows a schematic perspective view of a further embodiment of an apparatus 1 according to the invention. FIG. 2 moreover illustrates a further conceivable implementation of an embodiment for the method according to the invention.

In comparison to the exemplary embodiment of apparatus 1 in FIG. 1, there is no manipulator 12 and no horizontal conveying device 13 provided in the exemplary embodiment in FIG. 2. The handling device 7, as well as the packaging machine 3, is of the identical construction as in the exemplary embodiment in FIG. 1. Furthermore, a control unit S is present, which is linked to the handling device 7 and to the packaging machine 3.

Taking the new rolls 5 directly from the particular pallet 9 is carried out by engagement of the retaining mandrel 17 into the hollow cylindrical core 6 of the particular new roll 5 in FIG. 2, as well. The particular core 6 of depleted rolls 5 is likewise placed into a container 20.

FIG. 3 furthermore shows a schematic perspective view of two installation positions EB1 and EB2 as can be provided for an apparatus 1 or, as the case may be, for a packaging machine 3 according to the exemplary embodiments from FIGS. 1 and 2. Each of the installation positions EB1 and EB2 has an own pin 27, onto which pins 27 new rolls 5 are mounted by way of the handling device 7 (cf. FIGS. 1 and 2) and clampingly fixed to the particular pin 27 by increasing the diameter of the pins 27.

Also illustrated is a sealing bar 25, which is provided for attaching an outer layer 15 (cf. FIG. 5) of the new roll 5 mounted in the particular installation position EB1 or EB2, as the case may be (cf. FIG. 4), to the material web MB remaining in the packaging machine 3, and which is vertically lowered for this purpose. After attaching the outer layer 15 (cf. FIG. 4) to the material web MB remaining in the packaging machine 3, the temperature-controlled sealing bar 25 is vertically lifted and brought into the position illustrated in FIG. 3.

In FIG. 3, a roll 5 is positioned in the first installation position EB1 on the pin 27 of the first installation position EB1 and is rotatingly moved by the pin 27. In the process, the packaging material or, as the case may be, the shrink film of the roll 5 positioned on the pin 27 of the first installation position EB1 is unwound. In the second installation position EB2, a roll 5 has already been completely unwound and the core 6 (cf. FIGS. 1 and 2) has been removed by way of the handling device 7 (cf. FIGS. 1 and 2) such that the second installation position EB2 or, as the case may be, the pin 27 of the second installation position EB2 is ready for receiving a new roll 5 with packaging material.

Each of the installation positions EB1 and EB2 is associated with an own sensor system or, as the case may be, with a camera 19, wherein the rolls 5, which are at least approximately completely unwound and/or depleted, can be optically detected. When a roll 5 is at least approximately completely unwound and/or depleted, the particular camera 19 sends information on the particular roll 5, which is at least approximately completely unwound and/or depleted, to the control unit S. The control unit S hereupon activates the handling device 7 (cf. FIGS. 1 and 2) for the removal of the particular roll 5, which is at least approximately completely unwound and/or depleted or, as the case may be, for the removal of the core 6 of the particular roll 5, which is at least approximately completely unwound and/or depleted. In order to be able to remove the roll 5, which is at least approximately completely unwound and/or depleted, from its particular installation position EB1 or EB2, as the case may be, a clamping connection formed between the particular roll 5 and the pin 27 is first undone. This is carried out by way of decreasing the cross-sectional diameter of the particular pin 27. Undoing the clamping connection or, as the case may be, decreasing the cross-sectional diameter of the pins 27 is furthermore controlled by the control unit S.

By way of its retaining mandrel 15 (cf. FIG. 7), the handling device 7 dips into the core 6 of the at least approximately completely unwound and/or depleted roll 5 for the purpose of removing the at least approximately completely unwound and/or depleted roll 5 from its particular installation position EB1 or EB2, as the case may be. The particular at least approximately completely unwound and/or depleted roll 5 is then fixed to the retaining mandrel 15 of the handling device 7 by increasing the cross-sectional diameter of the retaining mandrel 15. Increasing the cross-sectional diameter of the retaining mandrel 15 is controlled by the control unit S.

After fixing the at least approximately completely unwound and/or depleted roll 5 to the retaining mandrel 15, the at least approximately completely unwound and/or depleted roll 5 is moved toward the container 20 (cf. FIGS. 1 and 2) via the handling device 7 and under the control of the control unit S, and it is deposited there in the container 20 by decreasing the cross-sectional diameter of the retaining mandrel 15.

After depositing the at least approximately completely unwound and/or depleted roll 5 or, as the case may be, the core 6 in the container 20 (cf. FIGS. 1 and 2), the handling device 7 is activated by way of the control unit S for mounting a new roll 5 in the particular installation position EB1 or EB2, as the case may be. A verification of the direction of rotation or, as the case may be, of the rotation-direction-conforming orientation of the particular new roll 5 can be carried out prior to that, as already described above. The apparatus 1 can thus be operated in an automated manner.

The exemplary embodiment according to FIG. 3 is intended to be understood as an example only, such that further embodiments are conceivable, in which there is only one camera 19 associated with the two installation positions EB1 and EB2, where the detection range of the camera 19 extends across the two installation positions EB1 and EB2.

It is also possible by way of the cameras 19 to verify a direction of rotation or, as the case may be, rotation-direction-conforming orientation of new rolls 5 mounted in the installation positions EB1 and EB2. If a wrong direction of rotation or, as the case may be, a non-rotation-direction-conforming orientation of new rolls 5 is determined in one of the two installation positions EB1 or EB2, as the case may be, an alignment correction of the particular new roll 5 by the handling device 7 can be induced by way of the control unit S. The handling device 7 can then remove the particular new roll 5 from its particular installation position EB1 or EB2, as the case may be, it can align it with the appropriate direction of rotation and/or rotation-direction-conforming orientation, and it can hereupon mount it again with the appropriate direction of rotation and/or rotation-direction-conforming orientation in its particular installation position EB1 or EB2, as the case may be.

The illustration in FIG. 4 shows the installation positions EB1 and EB2 of FIG. 3 with the mounted new roll 5 for the second installation position EB2. Based on FIG. 3, FIG. 4 shows a new roll 5 that has been slid onto the pin 27 of the second installation position EB2 by the handling device 7 (cf. FIGS. 1 and 2). Packaging material or, as the case may be, shrink film continues to be unwound from the roll 5 of the first installation position EB1 such that the packaging machine 3 (cf. FIGS. 1 and 2) can continue to be operated even while the roll 5 in the second installation position EB2 is being replaced. If a new roll 5 is mounted in the first installation position EB1, packaging material or, as the case may be, shrink film can continue to be unwound from the roll 5 in the second installation position EB2, thus enabling continuous and interruption-free operation of the packaging machine 3.

The new roll 5 of the second installation position EB2 from FIG. 4 has a reflective adhesive label 22, which is applied to the outer layer 15 of the new roll 5 in the area of its free end. The camera 19 associated with the second installation position EB2 is now able to verify, by the adhesive label 22, whether the new roll 5 has been slid onto the pin 27 with the appropriate direction of rotation or, as the case may be, with rotation-direction-conforming orientation. A synopsis of the FIGS. 4 and 5 illustrates that for the new roll 5 of the second installation position EB2 the outer layer 15 is guided from above over the roll 5 and dips downward. If the roll 5 had been positioned on the pin 27 of the second installation position EB2 with a wrong direction of rotation or, as the case may be, with a non-rotation-direction-conforming orientation, the outer layer 15 would face downward away from the roll 5 and could therefore not be gripped or could only be gripped with difficulty. An alignment below the sealing bar 25 would thus not be possible. A rotation-direction-conforming positioning of new rolls 5 or, as the case may be, a mounting of new rolls 5 in the particular installation position EB1 or EB2 with the appropriate direction of rotation is thus indispensable in order to be able to ensure disruption-free operation of the apparatus 1 or, as the case may be, of the packaging machine 3.

As soon as the adhesive label 22 has been detected by way of the particular camera 19, the pin 27 is rotatingly moved until the adhesive label 22 faces toward the oppositely located installation position EB1 or EB2, as the case may be. Only after this alignment of the adhesive label 22 can a gripping device and/or handling device 14, which is only illustrated in FIG. 5, grip the outer layer 15 of the new roll 5 and position it below the sealing bar 25.

Further embodiments are conceivable, in which the new rolls 5 have no reflective adhesive label 22 and in which the cameras 19 detect an externally arranged layer 15 of new rolls 5 or, as the case may be, the free end sections of new rolls 5 without an additional optical marking of the new rolls 5.

FIG. 5 shows the installation positions EB1 and EB2 of FIGS. 3 and 4 with extracted outer layer 15 of the new roll 5 mounted in the second installation position EB2. It is clearly discernible here that the externally arranged layer 15 of the roll 5, which is positioned in the second installation position EB2, dips downward coming from above, while the outer layer or, as the case may be, the material web MB of the roll 5 mounted in the first installation position EB1, is guided coming from below. Both rolls 5 rotate on their particular, associated pin 27 with the same direction of rotation or, as the case may be, counterclockwise. Rotation-direction-conforming mounting of the new rolls 5 is necessary in order to be able to ensure disruption-free and functioning operation of the apparatus 1 or, as the case may be, of the packaging machine 3 (cf. FIGS. 1 and 2).

It is thus possible both to determine a direction of rotation or, as the case may be, rotation-direction-conforming orientation via the cameras 19 and to detect at least approximately completely unwound and/or depleted rolls 5 via the cameras 19. Information on the direction of rotation or, as the case may be, on the rotation-direction-conforming orientation of new rolls 5, as well as information on at least approximately completely unwound and/or depleted rolls 5 is transmitted from the cameras 19 to the control unit S, which can control an alignment correction of new rolls 5 and a replacement of at least approximately unwound and/or depleted rolls 5 with new rolls 5.

With reference to the FIGS. 3, 4, and 5, it should be additionally noted that the two installation positions EB1 and EB2 for the rolls 5 with flat material and/or film material wound thereonto or, as the case may be, at least one of the installation positions EB1 and/or EB2 with their rotatable retaining means in form of the rotatable pins 27 for the rolls 5 of flat material and/or film material can be designed to be height-adjustable, for instance, in order to be able to carry out an adaptation to different roll diameters and/or a correction of the conveying paths with gradually depleting material supply of a roll 5, which is being unwound and which therefore gradually decreases in diameter. For this purpose, in particular the frames, at which the horizontally arranged pins 27 are rotatably held and mounted, can have suitable means for height adjustment of the rotatable pins 27.

Figure 6:
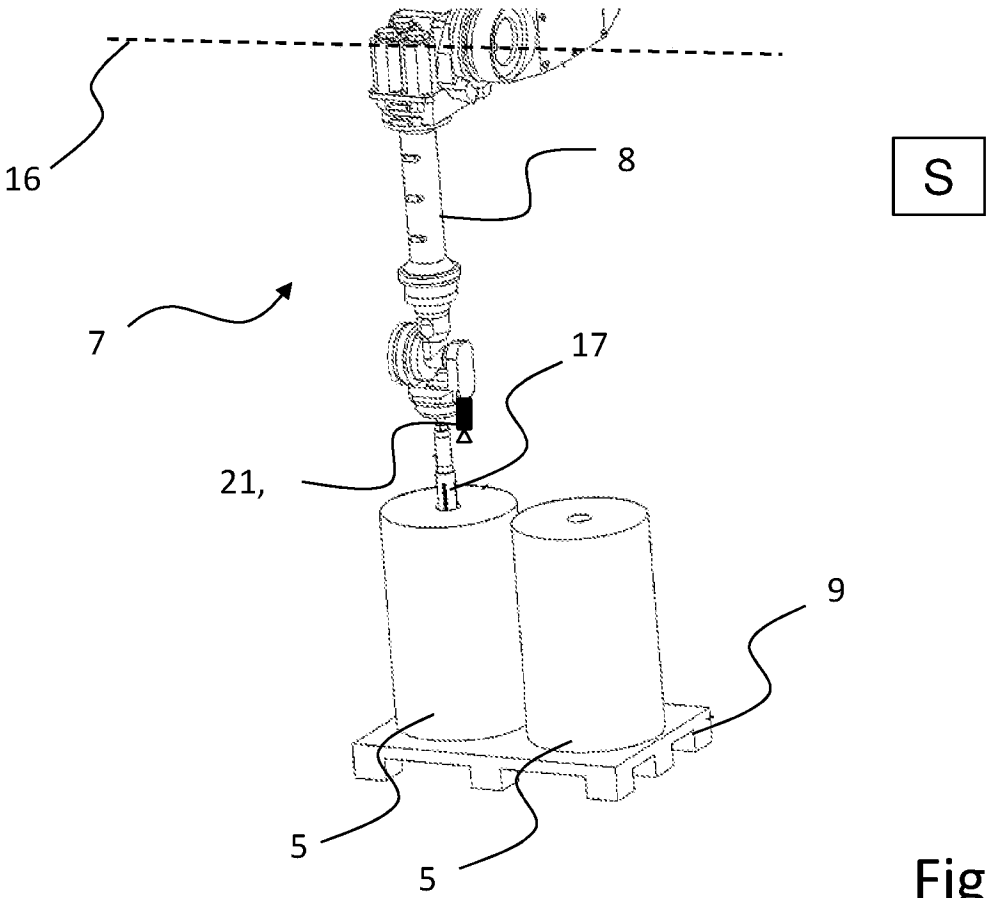
FIG. 6 shows a perspective view of a handling device as can be provided for conceivable embodiments of the apparatus according to the invention and for the implementation of the method according to the invention.
Figure 7:
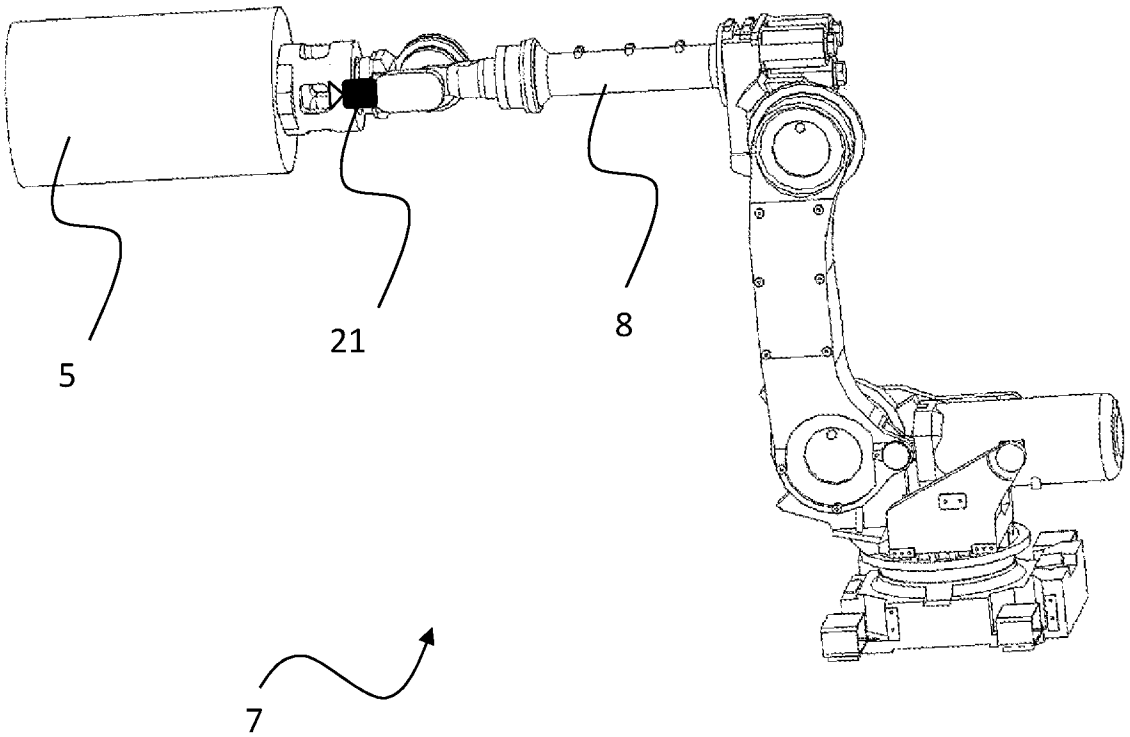
FIG. 7 shows the handling device from FIG. 6 after taking a new roll with rotation-direction-conforming orientation from a pallet.

FIG. 6 shows a perspective view of a handling device 7 as can be provided for conceivable embodiments of the apparatus 1 according to the invention and for the implementation of the method according to the invention.

The gripping arm 8 of the handling device 7 is pivotable about the horizontally oriented axis 16 such that the retaining mandrel 17 of the handling device 7 can be aligned with a vertical orientation of its longitudinal axis for the purpose of dipping into the core 6 of the particular new roll 5. If the particular new roll 5 has been seized by the handling device 7 or, as the case may be, by the retaining mandrel 17, the new roll 5 can be rotated about the axis 16 by another pivoting motion of the gripping arm 8 and can thereafter be mounted in its particular, associated installation position EB1 or EB2, as the case may be (cf. FIGS. 3 to 5).

FIG. 6 also shows a camera 21. The camera 21 is mechanically fixedly coupled with the gripping arm 8 such that it is guided together with the gripping arm 8 in a movement of the gripping arm 8. If the gripping arm 8 is pivoted about the axis 16, a direction of rotation or, as the case may be, rotation-direction-conforming orientation of one or more new rolls 5 can be determined by the camera 21. The camera 21 is linked to the control unit S, which effects a new roll 5 that has an appropriate direction of rotation or, as the case may be, rotation-direction-conforming orientation, to be taken from the pallet 9 by the handling device 7.

FIG. 7 finally shows the handling device 7 from FIG. 6 while taking a new roll 5 with rotation-direction-conforming orientation from a pallet 9 (cf. FIG. 6). As is discernible in FIG. 7 and based on the position of the gripping arm 8 in FIG. 6, the gripping arm 8 was pivoted about the axis 16, which runs in the direction of the image plane in FIG. 7. The new roll 5 now has an at least approximately horizontal orientation and can be mounted in its particular, associated installation position EB1 or EB2, as the case may be.

The removal of the at least approximately completely unwound and/or depleted roll 5 from the particular installation position EB1 or EB2, as the case may be, is likewise carried out in a horizontal orientation.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

1 Apparatus
3 Packaging machine
5 Roll
6 Core
7 Handling device
8 Gripping arm
9 Pallet
11 Retaining mandrel
12 Manipulator
13 Horizontal conveying device
14 Gripping device and/or handling device, Guide rod
15 Externally arranged layer, outer layer
16 Axis of rotation, horizontal axis
17 Retaining mandrel
19 Camera, sensor system, optical detector
20 Container
21 Camera, optical detector
22 Reflective adhesive label, optical marker
25 Sealing bar
27 Pin
30 User, operator
EB1 Installation position
EB2 Installation position
MB Material web
S Control unit

The invention claimed is:

1. A method for handling flat material or film material that is wound onto rolls (5) comprising:

initially mounting a first roll (5) of flat material or film material on one of at least two installation positions (EB1; EB2) of a packaging machine (3) and guiding a material web (MB) of the first roll into the packaging machine (3);

after at least partially depleting the first roll (5) of flat material or film material, mounting a new roll (5) of flat material or film material on the remaining installation position of the least two installation positions (EB1; EB2) of the packaging machine (3), after mounting the new roll (5), attaching an externally arranged layer (15) of the new roll (5) near or in the area of a free end of the new roll (5) to a section of a material web (MB) of the first roll (5) being guided in the packaging machine (3), and after the externally arranged layer (15) is attached to the material web (MB), sensor detecting and autonomously replacing, using a handling device (7), the first roll (5), when it is depleted or nearly depleted, with another new roll (5) at the installation position previously occupied by the first roll (5).

2. The method of claim 1, wherein the direction of rotation or the rotation-direction-conforming orientation of the new roll (5) is determined or verified before, while, or after the new roll (5) is mounted, and, if a wrong direction of rotation or a non-rotation-direction-conforming orientation is determined, performing an alignment correction of the new roll (5) or the new roll (5) is replaced with another new roll with appropriate direction of rotation or rotation-direction-conforming orientation.

3. The method of claim 2, further comprising verifying or determining the direction of rotation or the rotation-direction-conforming orientation of the new rolls (5) utilizing at least one detector (19, 21) that is part of the handling device (7).

4. The method of claim 3, further comprising unmounting and remounting the new roll (5), wherein in the handling device (7) remounts the new roll (5) with the appropriate direction of rotation or rotation-direction-conforming orientation.

5. The method of claim 3 wherein the at least one detector (19, 21) is an optical detector.

6. The method of claim 1, wherein each new roll (5) comprises at least one marker (22) in the area of a free end of the new roll (5), and each new rolls (5) is mounted such that the at least one marker (22) faces toward the other installation position (EB1, EB2).

7. The method of claim 6, wherein the at least one marker (22) is an optical marker that is applied onto the flat material or film material of the new roll (5) before the new roll (5) is mounted in its installation position (EB1, EB2) such that the optical marker largely immovably fastens the free end of the new roll (5) to the flat material or film material of the new roll (5).

8. The method of claim 7, further comprising inserting a retaining mandrel (17) of the handling device (7) into a face side of the new roll (5), which is designed as hollow body, and increasing a maximum cross-sectional diameter of the retaining mandrel (17) and thereby clampingly fixing the new roll (5) to the handling device (7).

9. The method of claim 8, further comprising moving new rolls (5) by way of at least one horizontal conveying device (13) and directly removing the new rolls (5) from the at least one horizontal conveying device (13) with the handling device (7).

10. The method of claim 9, further comprising controlling both the handling device (7) and the horizontal conveying device (13) with a control unit (S), wherein the control unit (S) controls a clocked operation of the horizontal conveying device (13) in consideration of removal of new rolls (5) from the horizontal conveying device (13) carried out by the handling device (7).

11. The method of claim 10, further comprising extracting the externally arranged layer (15) of the newly mounted roll (5) with a gripping device or handling device (14) operating with pneumatic suction pressure, mechanically clamping, or by electrostatic adhesion, wherein in the gripping device or handling device (14) moves back and forth between the at least two installation positions (EB1, EB2).

12. An apparatus (1) for handling flat material or film material that is wound onto rolls (5) and that serves as packaging material for the packaging of piece goods, bundles, or sets of articles, comprising:

a packaging machine (3) with at least two installation positions (EB1; EB2), wherein each installation position (EB1; EB2) provides for the rotating reception of rolls (5) of flat material or film material, a gripping device or handling device (14) and a sealing bar (25), which cooperate to align and attach a free end section of flat material or film material of newly mounted rolls (5) to a moving material web (MB) of a roll (5) that is already being guided into the packaging machine (3) at the time of mounting the new roll, at least one sensor system (19), covering the rolls (5) installed at the least two installation positions (EB1, EB2), and a control unit (S) in communication with the sensor system (19) and a handling device (7), wherein the handling device (7) is activatable by the control unit (S) when an installed roll (5) is at least approximately completely unwound or depleted, for the purpose of the autonomous replacement of the roll (5) with a new roll (5).

13. The apparatus of claim 12, further comprising at least one detector (19, 21) for verifying or determining a direction of rotation or a rotation-direction-conforming orientation of new rolls (5), and wherein the handling device (7) mounts the new rolls (5) with the direction of rotation or rotation-direction-conforming orientation that is appropriate for the particular installation position (EB1, EB2), or are alignable by the handling device (7) with the appropriate direction of rotation or rotation-direction-conforming orientation.

14. The apparatus of claim 13, wherein the at least one detector (19, 21) is a component of the handling device (7) and is movable with the handling device (7).

15. The apparatus of claim 12, wherein the handling device (7) comprises a cylindrically formed retaining mandrel (17) with an adjustable maximum cross-sectional diameter.

16. The apparatus of claim 15, further comprising a horizontal conveying device (13) arranged upstream from the handling device (7), and wherein the horizontal conveying device (13) is activatable in clocked operation by the control unit (S) in consideration of a removal of new rolls (5) by the handling device (7).

17. The apparatus of claim 16, wherein the at least one gripping device or handling device (14) is movable back and forth between the at least two installation positions (EB1, EB2), and is capable of temporarily gripping the free end sections of flat material or film material of new rolls (5) with pneumatic suction pressure, in a mechanically clamping manner, and/or by electrostatic adhesion.

* * * * *